US008935830B2

(12) United States Patent
Bailey

(10) Patent No.: US 8,935,830 B2
(45) Date of Patent: Jan. 20, 2015

(54) DOWNSPOUT HINGE SYSTEMS AND METHODS

(76) Inventor: Lance D. Bailey, Elkhorn, NE (US)

( * ) Notice: Subject to any disclaimer, the term of this patent is extended or adjusted under 35 U.S.C. 154(b) by 0 days.

(21) Appl. No.: 13/539,032

(22) Filed: Jun. 29, 2012

(65) Prior Publication Data

US 2013/0161944 A1 Jun. 27, 2013

Related U.S. Application Data

(63) Continuation-in-part of application No. 13/367,343, filed on Feb. 6, 2012.

(60) Provisional application No. 61/502,801, filed on Jun. 29, 2011.

(51) Int. Cl.

| | |
|---|---|
| ***E05D 5/06*** | (2006.01) |
| ***E04D 13/08*** | (2006.01) |
| ***E05D 5/04*** | (2006.01) |
| ***E05D 5/02*** | (2006.01) |
| *E05D 5/10* | (2006.01) |

(52) U.S. Cl.

CPC *E04D 13/08* (2013.01); *E05D 5/04* (2013.01); *E05D 5/06* (2013.01); *E05D 5/0215* (2013.01); *E05Y 2900/60* (2013.01); *E05D 2005/102* (2013.01); *E05Y 2800/21* (2013.01); *E05Y 2800/29* (2013.01); *E05Y 2800/45* (2013.01); *E05Y 2800/00* (2013.01); *E05Y 2600/40* (2013.01)

USPC ..... 16/390; 16/382; 16/386; 16/387

(58) Field of Classification Search

USPC ..... 16/390, 391, 392, 389, 252, 382, 384, 16/386, 387, 86.1; 403/153, 277, 278, 403/279; D8/323, 328, 329; 29/11; 49/381, 49/382; 256/21, 26, 54; 285/184, 181, 285/223, 283

See application file for complete search history.

(56) References Cited

U.S. PATENT DOCUMENTS

| | | | | | |
|---|---|---|---|---|---|
| 269,126 | A | * | 12/1882 | Shupe | 16/390 |
| 952,059 | A | | 3/1910 | Williiam | |
| 974,550 | A | | 11/1910 | Cardarelli | |
| 1,186,288 | A | * | 6/1916 | Cunningham | 16/390 |
| 1,382,083 | A | * | 6/1921 | Heyman | 16/390 |
| 1,448,646 | A | * | 3/1923 | Ward | 285/283 |
| 1,521,237 | A | * | 12/1924 | Fuller | 150/126 |
| 1,590,177 | A | * | 6/1926 | Andreotti | 16/392 |
| 1,640,525 | A | * | 8/1927 | Belliveau | 16/390 |
| 1,804,954 | A | * | 5/1931 | Rutherford | 285/181 |
| 1,974,233 | A | * | 9/1934 | Burke | 182/24 |

(Continued)

FOREIGN PATENT DOCUMENTS

| | | | | |
|---|---|---|---|---|
| CA | 1188476 | A | * | 6/1985 |
| CA | 2163469 | A | * | 5/1997 |

*Primary Examiner* — Chuck Mah

(74) *Attorney, Agent, or Firm* — Dax A. Anderson; Kirton McConkie

(57) ABSTRACT

A downspout hinge system where a plurality of downspout hinges are used as a one-size-fits-all solution for downspouts of a variety of sizes. The system of hinges utilize a first downspout hinge and a second downspout hinge coupling a downspout to a downspout extension. The downspout hinges are coupled to opposing surfaces of the downspout, including opposing sides of the same horizontal surface. Alternatively the downspout hinge may be coupled to opposing lateral sides of a downspout. Alternatively a downspout hinge may couple to more than one surface of the downspout.

10 Claims, 15 Drawing Sheets

(56) References Cited

U.S. PATENT DOCUMENTS

| | | | | | |
|---|---|---|---|---|---|
| 2,240,729 | A | * | 5/1941 | Von Palmenberg | 16/390 |
| 2,268,669 | A | * | 1/1942 | Moore | 160/229.1 |
| 2,277,176 | A | * | 3/1942 | Wagner | 16/366 |
| 2,369,480 | A | * | 2/1945 | Mills | 24/561 |
| 2,975,805 | A | | 3/1961 | Horn | |
| 3,006,039 | A | * | 10/1961 | Brydolf | 49/398 |
| 3,060,952 | A | | 10/1962 | Bystrom | |
| 3,108,295 | A | * | 10/1963 | Schor et al. | 114/354 |
| 3,153,807 | A | * | 10/1964 | Nyman | 16/390 |
| 3,171,157 | A | * | 3/1965 | Loughlin | 16/390 |
| 3,316,928 | A | | 5/1967 | Weakley | |
| 3,375,851 | A | | 4/1968 | Fitz et al. | |
| 3,861,419 | A | | 1/1975 | Johnson | |
| 3,911,954 | A | | 10/1975 | Johnson | |
| 4,135,540 | A | | 1/1979 | Felsen | |
| 4,270,572 | A | | 6/1981 | Jarzynka | |
| 4,441,835 | A | * | 4/1984 | Davis | 403/24 |
| 4,485,544 | A | * | 12/1984 | Van Ryswyk | 29/417 |
| 4,860,644 | A | * | 8/1989 | Kohl et al. | 454/65 |
| 5,014,745 | A | | 5/1991 | Watt | |
| 5,199,218 | A | * | 4/1993 | McQuade | 49/381 |
| 5,211,602 | A | * | 5/1993 | Holmgren | 454/63 |
| 5,336,130 | A | * | 8/1994 | Ray | 454/65 |
| 5,358,006 | A | | 10/1994 | Sweers | |
| 5,358,007 | A | | 10/1994 | Carlberg | |
| 5,375,891 | A | | 12/1994 | Sicotte et al. | |
| 5,435,051 | A | | 7/1995 | Cheremshynski | |
| 5,452,743 | A | | 9/1995 | Rortvedt | |
| 5,511,829 | A | * | 4/1996 | Sicotte et al. | 285/148.22 |
| 5,536,206 | A | * | 7/1996 | Bodmer et al. | 454/65 |
| D372,852 | S | * | 8/1996 | Noll et al. | D8/328 |
| 5,673,519 | A | | 10/1997 | McCaughan | |
| 5,735,085 | A | | 4/1998 | Denooy | |
| 6,524,180 | B1 | * | 2/2003 | Simms et al. | 454/65 |
| 6,701,675 | B1 | | 3/2004 | Ekker et al. | |
| 6,827,103 | B2 | * | 12/2004 | Cheremshynski et al. | 137/615 |
| 6,880,295 | B2 | | 4/2005 | Frey | |
| 7,198,423 | B2 | * | 4/2007 | Mathieu et al. | 403/52 |
| D557,586 | S | | 12/2007 | Shire et al. | |
| 7,665,187 | B1 | * | 2/2010 | Elowsky | 16/390 |
| 7,958,680 | B2 | * | 6/2011 | DeNooy | 52/97 |
| 2004/0035473 | A1 | * | 2/2004 | Cheremshynski et al. | 137/615 |
| 2008/0251150 | A1 | | 10/2008 | Denooy et al. | |
| 2009/0148227 | A1 | * | 6/2009 | Wents | 403/205 |

* cited by examiner

DOWNSPOUT HINGE SYSTEMS AND METHODS

RELATED APPLICATIONS

This application is a Continuation-in-Part of U.S. patent application Ser. No. 13/367,343, filed Feb. 6, 2012, which claims priority to Provisional Patent Application No. 61/502,801, filed Jun. 29, 2011.

BACKGROUND

Background of the Invention and Related Art

Downspouts are often used to control water flow coming off of roofs. Downspouts distribute water onto the ground and potentially away from the foundation of a building by use of extensions that take the water from the downspout to a distance away from a foundation of a building. However, oftentimes, an integrated downspout hinge must be specifically sized for a particular downspout is required.

SUMMARY AND OBJECTS OF THE INVENTION

A downspout hinge system and method comprises a first downspout hinge and a second downspout hinge, the first downspout hinge and the second downspout hinge coupled to a downspout on opposing sides of the end of a downspout to form a downspout hinge system. In certain exemplary embodiments the opposing sides may be on opposing sides of the same surface. Alternative exemplary embodiments may comprise opposing sides a single structure. In certain alternative exemplary embodiments opposing sides may further comprise opposing sides of a surface and opposing sides of a structure.

In certain embodiments, the downspout hinge system may further comprise a first and second downspout hinge coupled to the anterior surface of the downspout and the orthogonal surface is coupled to the lateral surface of the downspout.

In certain alternative exemplary embodiments the downspout hinge system may further comprise at least one downspout hinge further comprises sandwich mechanism.

In certain alternative exemplary embodiments the downspout hinge system may further comprise at least one downspout hinge further comprises downspout material, such as sheet metal from a downspout, inserted between a sandwich mechanism.

In certain alternative exemplary embodiments the downspout hinge system further comprises a securing device which secures the downspout hinge to downspout material.

A sandwich mechanism provides support to the edge of a downspout. The sandwich mechanism comprises a structure for receiving material such as a downspout and securing two separate received materials together. In certain alternative exemplary embodiments the sandwich mechanism comprises a first member and a second member disposed opposite the first member to form a pocket between the two members. An embodiment may comprise a pinched "U" shaped configuration wherein the space or pocket between the vertical legs of the U are configured to receive material such as sheet metal. The sandwich mechanism comprises the receiving structure without the material received therein. Alternative sandwich mechanism further comprise sheet metal inserted into the pocket.

An alternative exemplary embodiment of the sandwich mechanism comprises a leaf comprising a first end and a second end wherein the second end of the leaf is folded over the first end of the leaf so that a portion of the second end of the leaf is positioned or disposed adjacent to the first end of the leaf. A pocket is formed between the first end of the leaf and the second end of the leaf folded over the first end of the leaf.

The sandwich mechanism improves the strength of the edge of the downspout because it presses material between the sandwich, which supports both the inside surface and the outside surface of the edge of the material inserted therein.

In certain exemplary embodiments the material is secured using a screw, pin or other securing means. Alternatively, the material may be secured by adhesive. Alternatively the material is secured by friction. Alternatively the material is secured by welding.

A brace is disclosed that can securely couple to the edge of a downspout or a downspout extension or even allow a downspout extension to be connected to a downspout. In certain embodiments, the brace comprises a pivot joint that allows the downspout to be easily rotated from a relatively horizontal position to a relatively vertical position in which people can access the areas where the downspout extension. Various hinge embodiments are described herein. For example, in some embodiments, the hinge includes a first plate positioned on the inner wall surface of a downspout and a second plate positioned on an opposing outer wall surface of the downspout. The wall is secured to the hinge and reinforced as a fastener is extended though the first plate, the downspout wall, and the second plate.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE EXEMPLARY EMBODIMENTS

Figure 1:
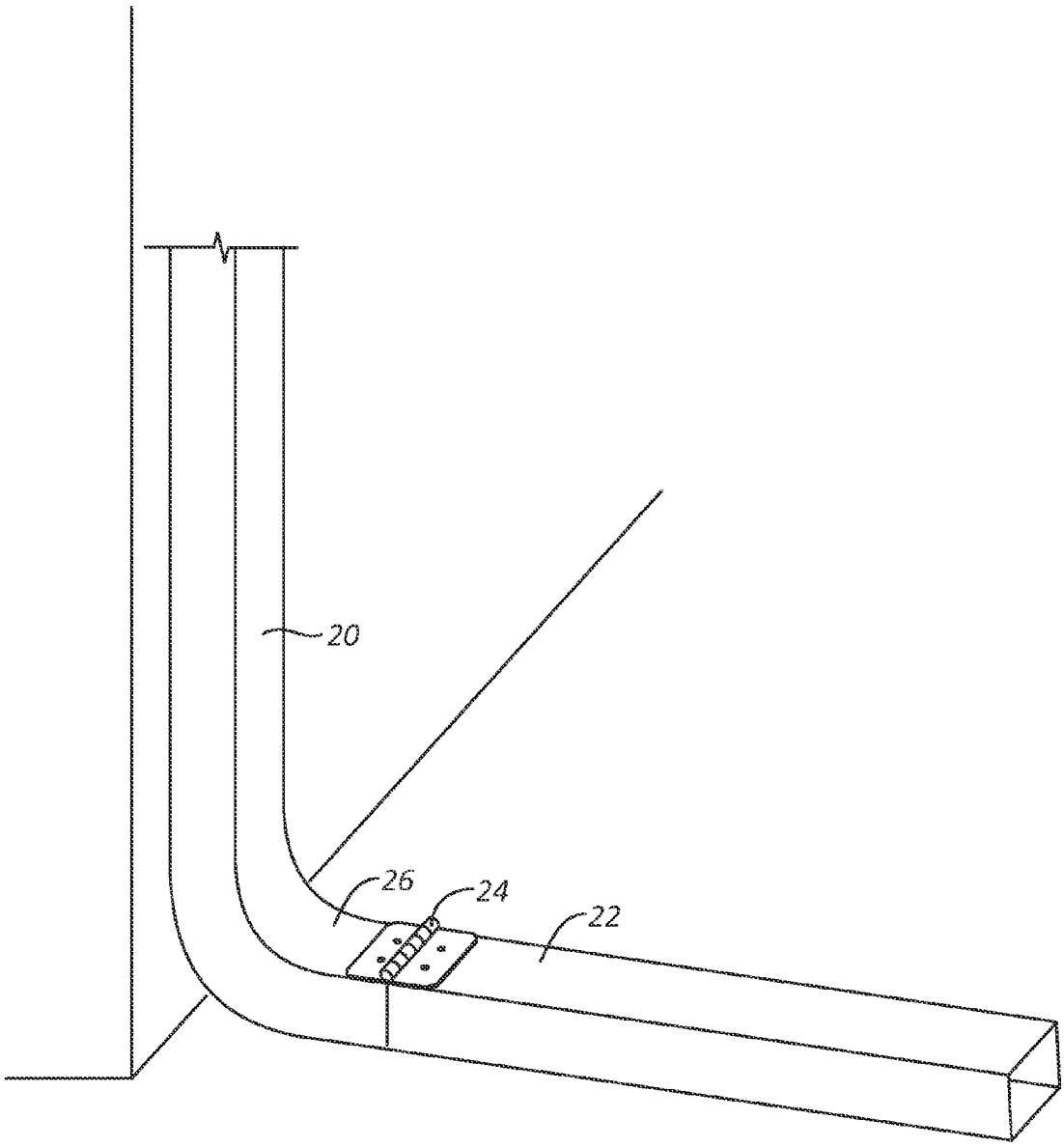
FIG. 1 illustrates a perspective view of a representative embodiment of a downspout with a downspout extension and a hinge.

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Numerical data may be expressed or presented herein in a range format. It is to be understood that such a range format is used merely for convenience and brevity and thus should be interpreted flexibly to include not only the numerical values explicitly recited as the limits of the range, but also as including all the individual numerical values or sub-ranges encompassed within that range as if each numerical value and sub-range is explicitly recited. As an illustration, a numerical range of "about 1 to 5" should be interpreted to include not only the explicitly recited values of about 1 to 5, but also include individual values and sub-ranges within the indicated range. Thus, included in this numerical range are individual values such as 2, 3, and 4 and sub-ranges such as 1-3, 2-4, and 3-5, etc. This same principle applies to ranges reciting only one numerical value and should apply regardless of the breadth of the range or the characteristics being described.

The description may use perspective-based descriptions such as up/down, back/front, left/right and top/bottom. Such descriptions are merely used to facilitate the discussion and are not intended to restrict the application or embodiments of the present invention.

For the purposes of the present invention, the phrase "A/B" means A or B. For the purposes of the present invention, the phrase "A and/or B" means "(A), (B), or (A and B)." For the purposes of the present invention, the phrase "at least one of A, B, and C" means "(A), (B), (C), (A and B), (A and C), (B and C), or (A, B and C)." For the purposes of the present invention, the phrase "(A)B" means "(B) or (AB)", that is, A is an optional element.

Various operations may be described as multiple discrete operations in turn, in a manner that may be helpful in understanding embodiments of the present invention; however, the order of description should not be construed to imply that these operations are order dependent.

The description may use the phrases "in an embodiment," or "in various embodiments," which may each refer to one or more of the same or different embodiments. Furthermore, the terms "comprising," "including," "having," and the like, as used with respect to embodiments of the present invention, are synonymous with the definition afforded the term "comprising."

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical or electrical contact. However, "coupled" may also mean that two or more elements are not in direct contact with each other, but yet still cooperate or interact with each other.

Figure 2:
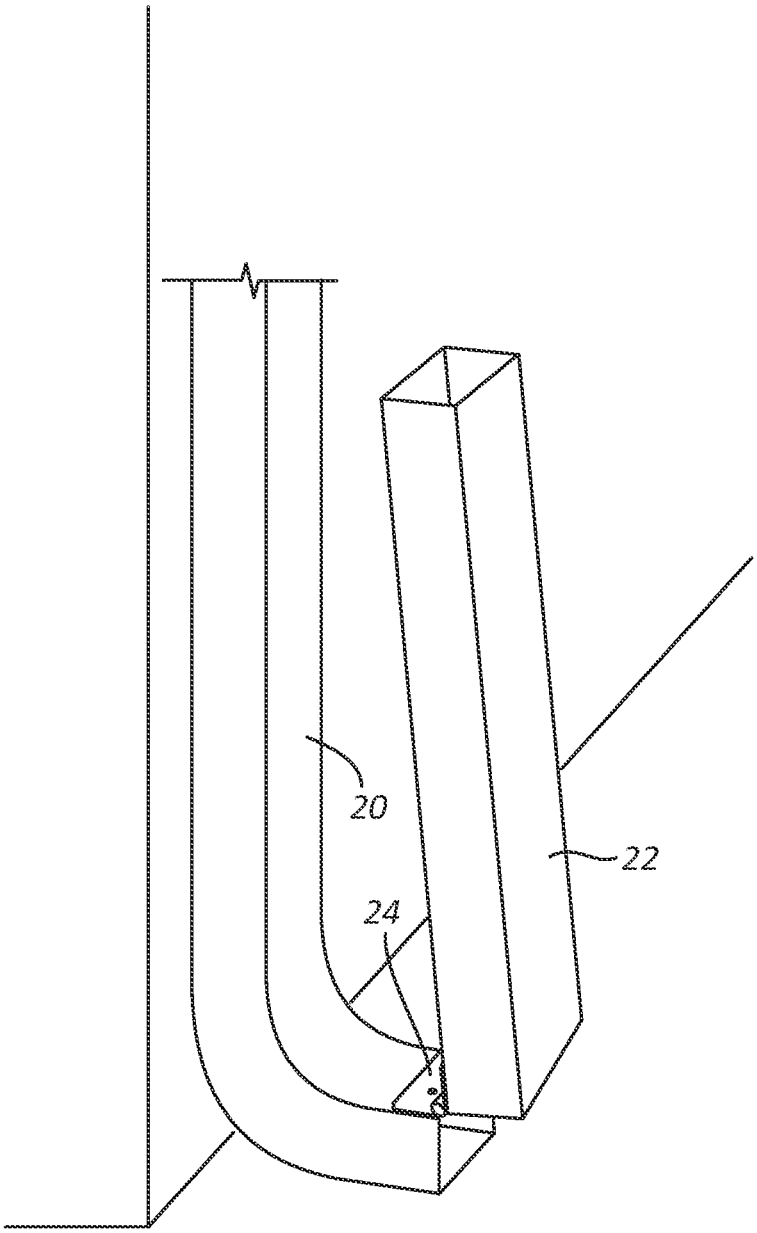
FIG. 2 illustrates a perspective view of the downspout and a downspout extension of FIG. 1 with the downspout extension in a vertical position.

Reference will now be made more particularly to embodiments of the present downspouts and hinged downspout extensions. As shown in FIG. 1, downspouts 20 can be used to control water flow coming off of roofs. Downspouts 20 can distribute water onto the ground and potentially away from the foundation of a house or other edifice by use of a downspout extension 22. In some instances, a downspout 20 includes an elbow or bend 26 that directs water away from a foundation of the building. Because the downspout extension 22 extends away from the building, it may occasionally interfere with landscape maintenance, foot traffic, and other use of the area around the downspout extension 22. Thus, a sandwich hinge 24, also referred to herein as hinge, can be provided that enables the downspout extension to be raised up to a vertical position, as shown in FIG. 2. The sandwich hinge 24 can allow the downspout extension 22 to selectively pivot up off the ground without removing the downspout extension 22 to the downspout 20.

In some embodiments, the sandwich hinge 24, including all of its component parts, is made of any desirable material with suitable properties and/or characteristics. By way of non-limiting example, in some embodiments, the hinge 24 is made of one or more of the following materials or combinations thereof: metallic materials, polymer materials, composite materials, synthetic materials, or resins. Non-limiting examples of specific metallic materials include: aluminum, steel, iron, stainless steel, and combinations and alloys thereof. In such embodiments, the desirable or selected material is homogenous or uniform throughout while in other embodiments the selected material includes voids or encapsulates non-homogenous materials. In some embodiments, the material selected is dictated by the intended use and/or method of manufacture of the sandwich hinge 24. For example, in embodiments wherein the hinge is formed by bending a flat sheet of material, the material can be bendable and durable. For instance, in some instances, the two hinge members 140 are manufactured of heavy duty aluminum. This material can resist corrosion even in wet outdoor environments. The thickness of the material of the two hinge members 140 can be between about 0.01 and about 0.1 inches, such as about 0.01 inches, about 0.02 inches, about 0.024 inches, about 0.03 inches, about 0.04 inches, about 0.05 inches, about 0.06 inches, about 0.07 inches, about 0.08 inches, about 0.09 inches, and about 0.1 inches. Using materials of these thicknesses can enable screws 136 inserted through the hinge members 140 to be retained, rather than backing out over time.

Figure 3:
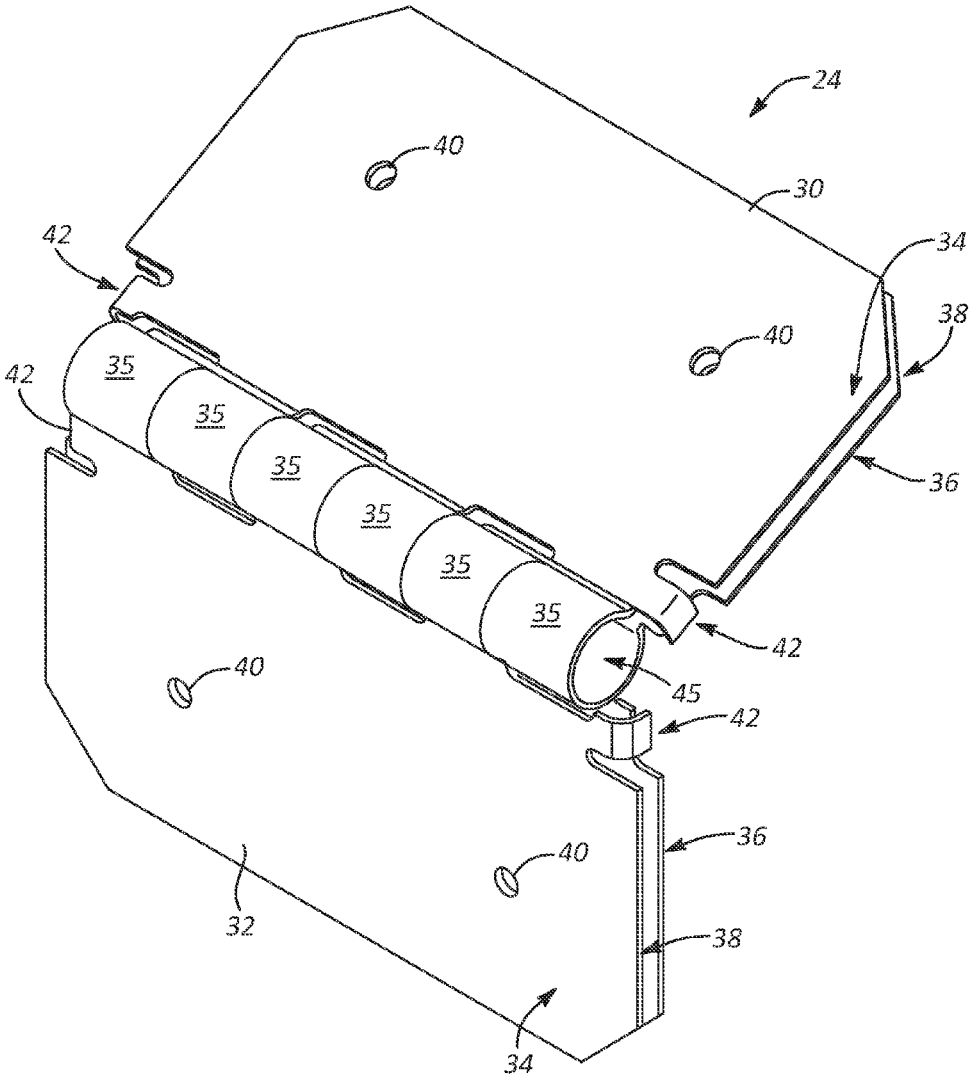
FIG. 3 illustrates a perspective view of a representative embodiment of a hinge.

FIG. 3 illustrates an isolated view of some embodiments of a representative sandwich hinge 24. As shown, the sandwich hinge 24 can include a first section 30 and a second section 32 coupled together with a pivoting member 35. In some configurations the sandwich hinge 24 consists of only the first 4 second sections 30, 32. The first and second sections 30, 32 can be substantially identical in function and structure. In use, a wall of the downspout 20 can be connected to the first section 30 and wall of the downspout extension 22 can be connected to the second section 32. These connections can enable the downspout extension 22 to be pivotally raised upwards to a vertical orientation, as shown in FIG. 2.

In some embodiments, each of the first and second sections of the hinge 30, 32 can include two substantially parallel plates 34, 36 separated by a gap 38. The gap 38 can be shaped and size to receive a wall of the downspout 20 or downspout extension 22 in a relatively snug manner that permits little play or movement therein. Furthermore, the two plates 34, 36 can include pilot holes 40 formed therein through which a screw, brad, or other fastener can be inserted to secure the wall of the downspout 20 or downspout extension 22 between the plates 34, 36. The pilot holes 40 can be pre-stamped and/or pre-drilled. The pilot holes 40 can be sized to accommodate a suitably sized screw. In a non-limiting example, the pilot holes 40 have a diameter of about 1/16 of an inch, 3/32 of an inch, about 1/8 of an inch, about 5/32 of an inch, or about 3/16 of an inch.

When the two parallel plates 34, 36 are secured about a wall of a downspout 20 or downspout extension 22, the parallel plates 34, 36 can reinforce the wall. Since the walls are generally thin aluminum or other such thin materials, they can tear or bend under stress. The parallel plates 34, 36 can thus provide reinforcement to these wall portions to prevent damage during use of the hinge.

In some configurations, a flange 42 is formed between the plates 34, 36 which can ensure a proper spacing of the gap 38 and also limit the depth with which a wall of the downspout 20 or downspout extension 22 can be inserted within the gap 38. As shown, the flange 42 can be coupled to one or both plates 34, 36. In some embodiments, the flange 42 is formed by bending a portion of one of the plates 34, 36. The flange 42 can provide a space of a predetermined distance between the end of the downspout 20 wall or the downspout extension 22 wall within the plates 34, 36 that can improve the function of the sandwich hinge 24 in normal use by lowering the likelihood of catching or binding.

As shown, in some embodiments, the sandwich hinge 24 include one or more pivot members 35 that are coupled to the plates 34, 36 of the first and second sections 30, 32. The pivot members 35 can form a hinge pin channel 45 into which a hinge pin (shown as 55 in FIGS. 8A-8B) can be inserted. The hinge pin 55 can serve to connect the first section 30 and the second section 32 of the sandwich hinge 24 together, as well as to facilitate pivoting of the first section 30 and the second section 32 about the pivot member 35.

Figure 4:
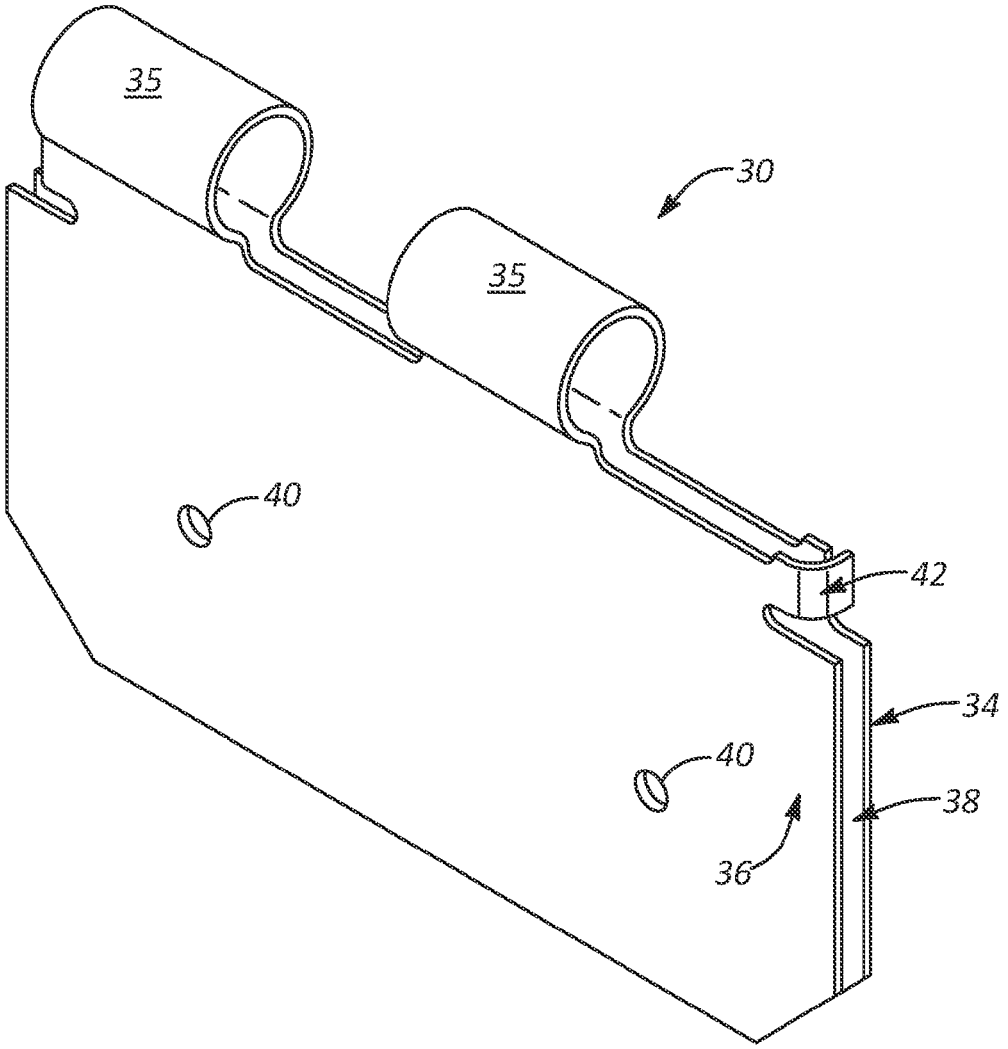
FIG. 4 illustrates a perspective view of an alternative representative embodiment of a hinge.
Figure 5:
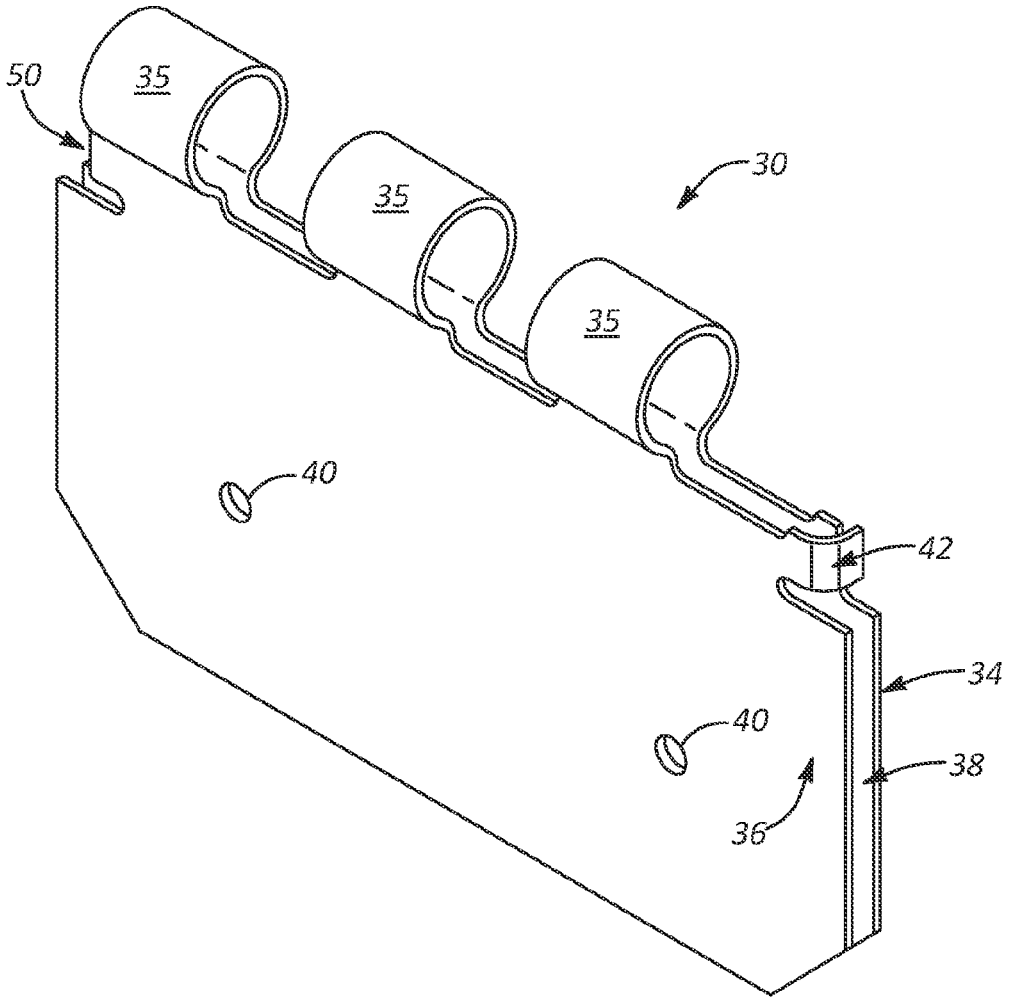
FIG. 5 illustrates a perspective view of an alternative representative embodiment of a hinge.

FIG. 4 illustrates embodiments of a section 30 of a sandwich hinge 24 that includes two pivot members 35 rather than three as in the embodiments of FIGS. 3 and 5. In other embodiments, a single section 30, 32 can include only one pivot member 35, four pivot members 35 or more than four pivot members 35. FIG. 5 illustrates embodiments of a section 30 of a sandwich hinge 24 that includes three pivot members 35. In both of the embodiments illustrated in FIGS. 4 and 5, the illustrated section 30 of the sandwich hinge 24 could be coupled with another section 32 using a hinge pin 55 to form the sandwich hinge 24, as shown in FIG. 3.

Figure 6:
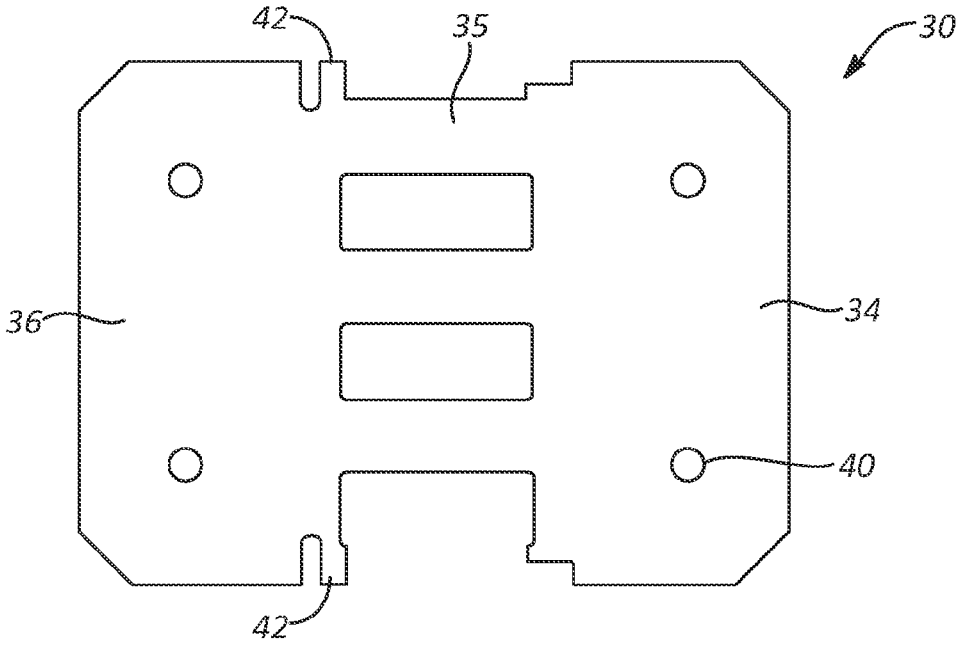
FIG. 6 illustrates a plan view of a section of the hinge of FIG. 5, according to some embodiments.
Figure 7A:
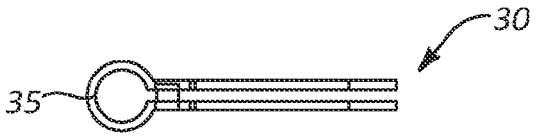
FIG. 7A illustrates a top view of a section of the hinge of FIG. 5, according to some embodiments.
Figure 7B:
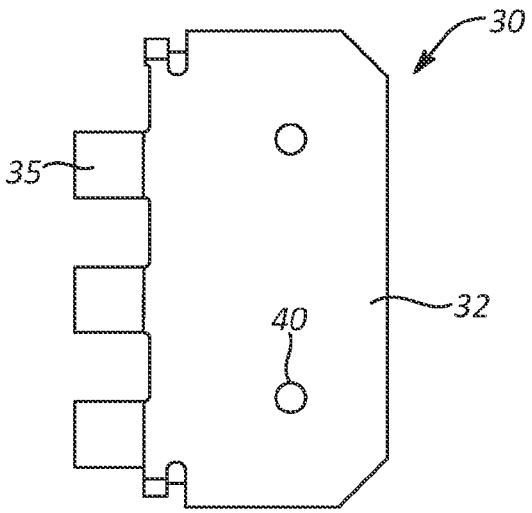
FIG. 7B illustrates a front side view of a section of the hinge of FIG. 5, according to some embodiments.
Figure 7C:
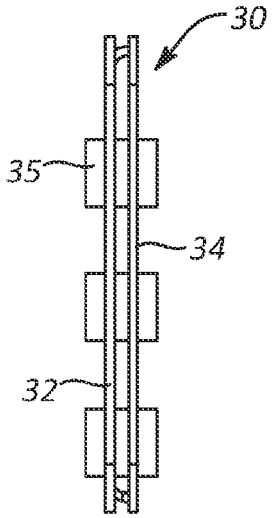
FIG. 7C illustrates a side view of a section of the hinge of FIG. 5, according to some embodiments.

FIG. 6 illustrates a plan view of the section 30 of the sandwich hinge 24 shown in FIG. 5. This section 30 can be stamped, cut, drilled, or otherwise formed of a unitary, single-piece material. Using one or more folding processes, the section 30 can be formed into the section 30 illustrated in FIG. 5. FIG. 7A illustrates a top view of the section 30 of FIG. 5. FIG. 7B illustrates a front side view of a section 30 of FIG. 5. And, FIG. 7C illustrates a side view of the section 30 FIG. 5.

Figure 8A:
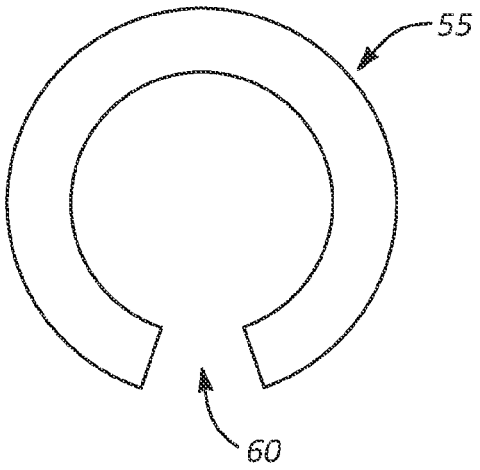
FIG. 8A illustrates a top view of a hinge pin, according to some embodiments.
Figure 8B:
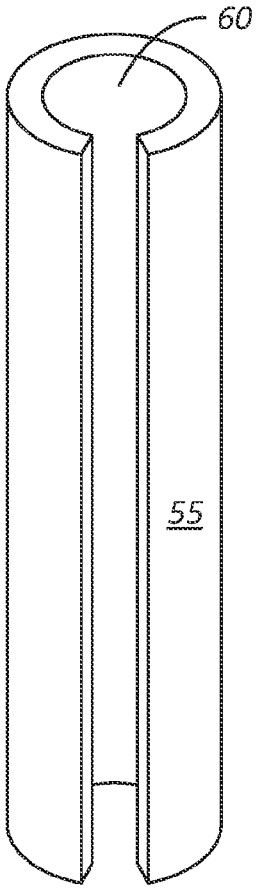
FIG. 8B illustrates a perspective view of a hinge pin, according to some embodiments.

FIGS. 8A and 8B illustrates embodiments of a hinge pin 55 configured to be inserted into a hinge pin channel 45 of the sandwich hinge 24. As shown, the hinge pin 55 can include a cylindrically formed material having a gap 60 extending longitudinally along the hinge pin 55. The gap 60 can allow the hinge pin 55 to contract and expand as it is inserted into the hinge pin channel 45.

When assembled, the ability to pivot the sandwich hinge 24 can be adjusted by applying opposite compressive forces against the parallel plates 34, 36 to decrease the size of the gap 38 and reduce the size of the hinge pin channel 45. As the size of the hinge pin channel 45 decreases, the force on the hinge pin 55 is increased, creating friction that resists pivoting movements of the sandwich hinge 24. As this force is increased, the downspout extension 22 can be elevated to the vertical position and remain in that position while to enable users to access the areas under the downspout extension 22 for maintenance, care, foot traffic, or other uses.

Figure 9:
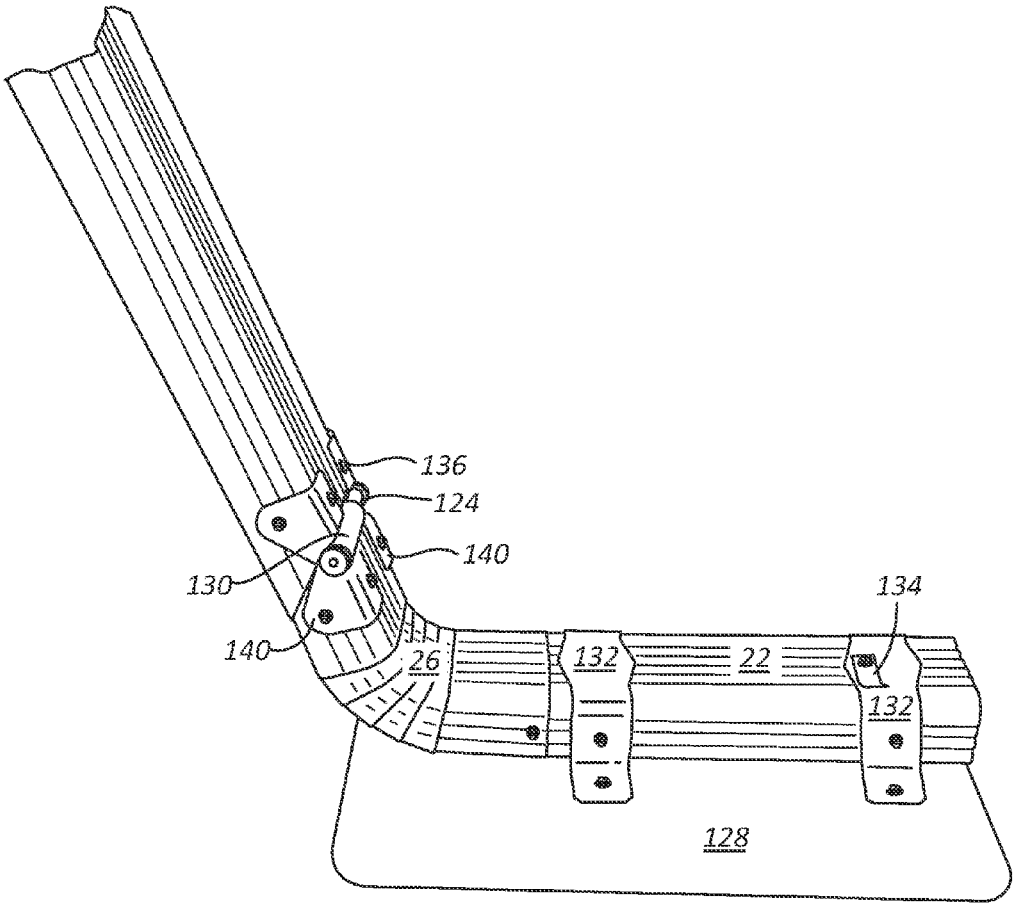
FIG. 9 illustrates a perspective view of another representative embodiment of a downspout with a downspout extension and a hinge.

Reference will now be made to FIGS. 9 through 13, which illustrate other embodiments of a hinged downspout 20. Reference will first be made to FIG. 9, which depicts a downspout 20 pivotally coupled to a downspout extension 22. The downspout extension 22 may rest on the ground or on another surface. A mounting surface 128 can be connected to the downspout extension 22 using one or more bands that are wrapped around the downspout extension 22 and fastened to the mounting surface 128 and the downspout extension 22. The downspout extension 22 also can include a latch 134 that latches the downspout extension 22 in a vertical orientation when it is lifted up. The latch 134 can be pivotally coupled to the downspout extension 22 so that the latch 134 can pivot about a fastener and latch itself to a feature (not shown) of the downspout 20. In other words, the latch 134 can be used to hold the downspout extension 22 in the vertical position until the property owner rotates it horizontally to allow the downspout extension 22 to rest in the horizontal position.

As shown, in some embodiments, the hinge 124 can include two hinge members 140. These two hinge members 140 can function together to stabilize the downspout 20 and the downspout extension 22 both vertically and horizontally. Improved, the horizontal and vertical stability can be provided by the portions of the hinge members 140 that connect to the side walls of the downspout 20 acting in combination with the portions of the hinge members 140 that connect to the front wall of the downspout 20. This stability can allow the two hinge members 140 to be fastened to the downspout 20, the downspout elbow 26, or the downspout extension 22.

Figure 10:
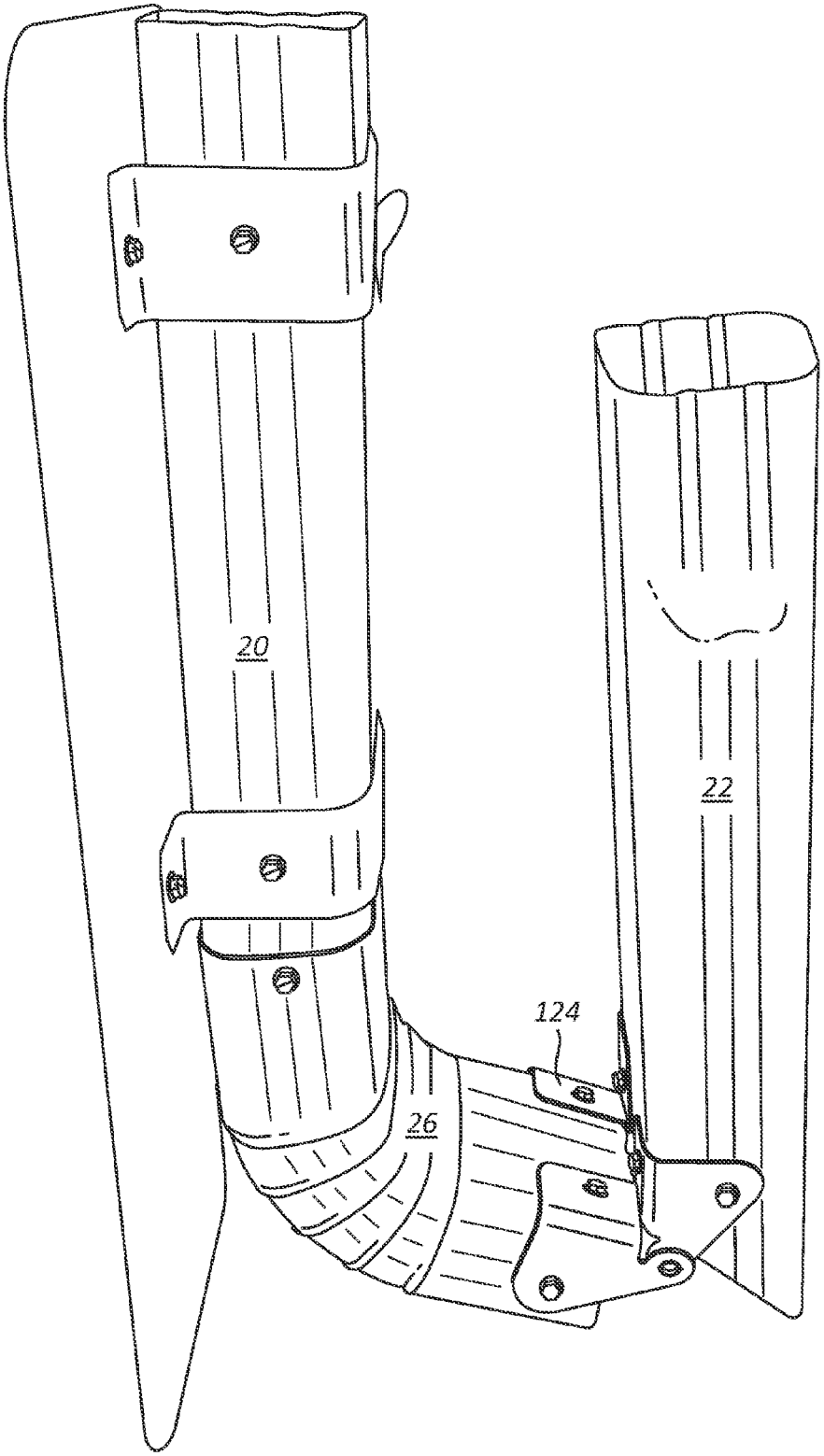
FIG. 10 illustrates a perspective view of the representative embodiment of FIG. 9 in a vertical position.

The use of two opposing hinge members 140 located both above and on the side of the downspout 20 or downspout extension 22 can give this hinge 124 enhanced stability and durability as it guides the downspout extension 22 in its lateral rotations between the horizontal position, shown in FIG. 9, and the vertical position, shown in FIG. 10. The opposing hinge members 140 can also function to protect and guide the downspout extension 22 as it is lowered to the horizontal position by accurately aligning it with the elbow 26. Additionally, the use of two opposing hinge members 140 to form a single hinge unit 142 can allows this hinge 142 to be installed on any sized downspout extensions 22, reducing the need to shop for or carry more than one size of hinge.

The use of the two hinge members 140 can enable the hinge 124 to pivot about a relatively large range of motion. For instance, the hinge 124 can pivot about 100 to about 160 degrees which allows the downspout extension 22 to be raised past the vertical position. This allows the downspout extension 22 to remain in the vertical position without falling back to the horizontal position until the user moves the downspout extension 22 to the horizontal position.

Each of the two hinge members 140 can be nearly identical or identical, reducing the need for carrying and/or purchasing two separate components. Each of the two hinge members 140 can be made to be more strong and more durable than the material of the downspout 20 and the downspout extension 22. This can add strength and stability to the downspout 20 and the downspout extension 22, which are sometimes made of thin sheets of aluminum. This can further alleviate the issues of instability and weakness associated with the lighter aluminum as the heavy and stronger hinge members 140 sandwiches the lighter material of the downspout 20 and the downspout extension 22. For instance, in some instances, the two hinge members 140 are manufactured of heavy duty aluminum. This material can resist corrosion even in wet outdoor environments. The thickness of the material of the two hinge members 140 can be between about 0.01 and about 0.1 inches, such as about 0.01 inches, about 0.02 inches, about 0.024 inches, about 0.03 inches, about 0.04 inches, about 0.05 inches, about 0.06 inches, about 0.07 inches, about 0.08 inches, about 0.09 inches, and about 0.1 inches. Using materials of these thicknesses can enable screws 136 inserted through the hinge members 140 to be retained, rather than backing out over time.

As further shown in FIG. 9, the downspout 20 and the downspout extension 22 can be shaped to form a gap 130 when the downspout extension 22 is in a horizontal position. The length of the gap 130 when the downspout extension 22 is in a horizontal position can be between about 0.5 inches and about 1.0 inch, such as, for example, about 0.75 inches. The gap 130 can assist to ensure that the bottom of the downspout extension 22 underlaps the bottom of the elbow 26. If this gap 130 were not maintained the water may otherwise escape the elbow 26 before entering the downspout extension 22 causing water to enter the ground adjacent to the properties foundation and washed away landscaping. The gap 130 can also allow a property owner to quickly see if there is any debris caught in the elbow 26 of the downspout extension 22.

As shown, the gap 130 can be created in part by the geometry of the cut of the downspout 20 and the downspout extension 22. For example, the downspout 20 can be formed to taper downwards from the front to the back (the side closest to the home or building), as shown in FIGS. 9 and 10. Furthermore, the top of the downspout extension 22 can be cut relatively flat at a constant location along the longitudinal axis of the downspout extension 22.

Figure 11:
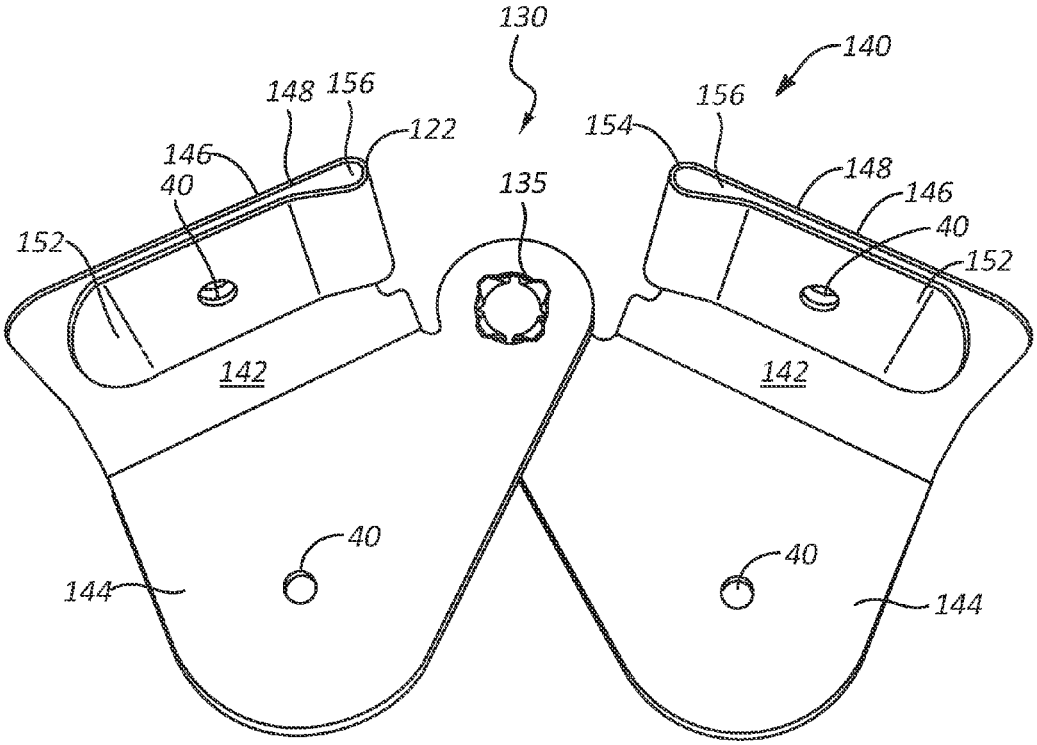
FIG. 11 illustrates an isolated perspective view of a hinge member of FIG. 9.

Reference will now be made to FIGS. 11 and 13A-13D. FIG. 11 illustrates an isolated hinge member 140. A hinge member may comprise a sandwich mechanism 122. A hinge mechanism may comprise a first front plate 148, and a second front plate 152 wherein the first front plate and the second front plate are adjacently disposed to form a pocket 156 therein. An alternative exemplary embodiment of the sandwich mechanism further comprises a front member 146. As shown, an alternative exemplary embodiment of the hinge member 140 may further comprise a first side plate 144. An alternative exemplary embodiment may further comprise a second side plate 144 coupled to the first side plate 144 further comprising a pivot member 135. The first side plate 144 can be substantially parallel to the second side plate 144 to enable the hinge member 140 to pivot about the pivot point of the pivot member 135. A front member 146 can extend away from each of the first and second side plates 144. The front member 146 can be positioned on the front of the downspout, a side which is not adjacent a building and the side to which the downspout extension 22 extends. In some configurations, each of the front members 146 extends substantially perpendicularly from the side plate 144 from which it extends. In some configurations, the front member 146 does not immediately extend substantially perpendicularly from a side plate 144, but can include one or more other bends 143 that can conform to the exterior shape of the downspout 20 or downspout extension 22, as shown.

In certain exemplary embodiments, the pivot member or pivot joint 135 may be coplanar with the side plate 144 as illustrated in FIG. 11. Alternatively, the pivot joint, pivot hinge or pivot member 35 and may be coplanar with the first and second sections as illustrated in FIG. 3. In addition, alternative exemplary embodiments may comprise side plate 144 coupled to the first section or second section of the FIG. 3 to achieve the optimal strength.

The front member 142 may be shaped so as to maximize surface contact between the hinge member 140 and the down spout 20, 22, and thus strengthen and reinforce the downspout 20, 22 point of connection to the hinge member 140.

Each front member 146 can include a first front plate 148 and a second front plate 152. The first front plate 148 and the second front plate 152 can be substantially parallel to one another, at least for a substantially portion of their bodies. Moreover, as shown, the first front plate 148 and the second front plate 152 can be coupled together at an edge thereof that is closest to the pivot member 135. In some instances, this coupling is a fold 154 that forms a pocket 156. In use, a wall of the downspout 20 or downspout extension 22 can be inserted into the gap or pocket 156 between the first front plate 148 and the second front plate 152 until it abuts the fold 154 or other coupling. At this point, the wall of the downspout 20 or downspout extension 22 can be secured within the pocket 156 by driving a screw, brad, or other fastener through a pilot hole 40 extending through the first front plate 148 and the second front plate 152. As mentioned above, these two plates 148, 152 can reinforce the wall of the downspout 20 or downspout extension 22 to resist tearing or damage during use of the hinge 124.

FIG. 11 further shows that the side plates 144 can include one or more pilot holes 40 formed therein to secure the side plates 144 to sidewalls of the downspout 20 and a sidewall of the downspout extension 22. In this way, the hinge member 140 can significantly strengthen the lateral stability of the hinge 124. The pilot holes 40 in the side plates 144 and/or the first front plate 148 and the second front plate 152 can be sized to accommodate a suitably sized screw. In a non-limiting example, the pilot holes 40 have a diameter of about 1/16 of an inch, 3/32 of an inch, about 1/8 of an inch, about 5/32 of an inch, about 3/16 of an inch, or about 7/32 of an inch.

In some embodiments, each of the side members 144 and the corresponding front members 146 are formed of a single-piece of material that is folded to form the respective components and features. Furthermore, each of the sets of side members 155 and front members 146 can substantially mirrored each other, in that each set is substantially the mirror image of the other, as shown in FIG. 11.

In some embodiments a removable sheath or cover may be selectively placed to cover the gap formed between the down spout 20, 22.

Figure 11A:
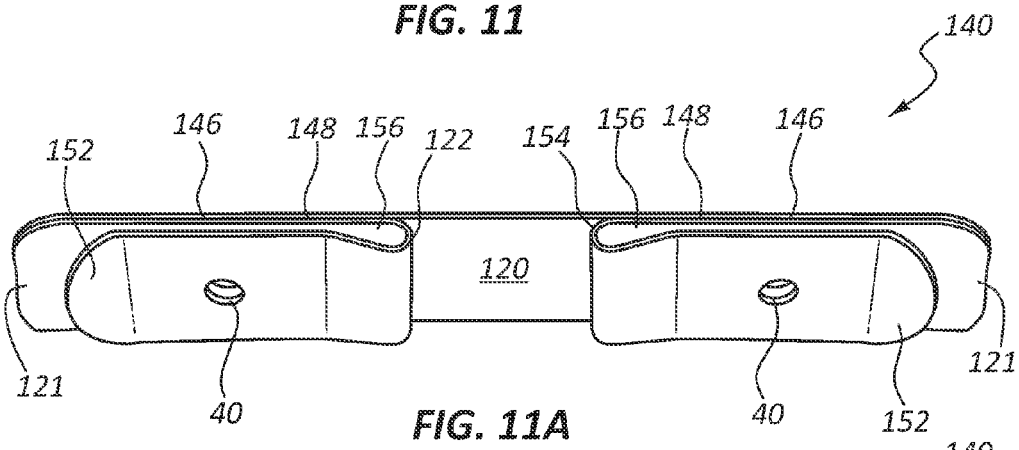
FIG. 11A illustrates a perspective view of a brace comprising a sandwich mechanism.
Figure 11B:
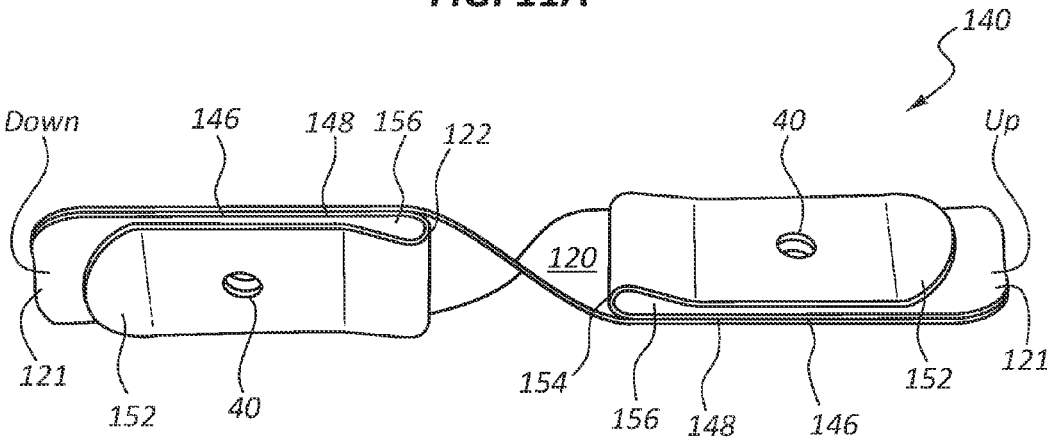
FIG. 11B illustrates a perspective view of a flexible brace comprising a sandwich mechanism on the top surface and a sandwich mechanism on the bottom surface.

Referring now to FIGS. 11A-11B, a brace is disclosed. The brace 120 may comprise a first plate 146 wherein the front plate 146 further comprises a rigid material such as stiff plastic, ceramic, or metal, Alternative exemplary embodiments may comprise flexing means comprising a flexible material such as flexible plastic, a composite material, malleable material, a fabric material such as rubber, glass or Kevlar or other flexible materials known in the art or a hinge which may comprise a hinge pin or may comprise members mating to secure the members in close proximity to one another while allowing one end to move independently of the other end. Alternative exemplary embodiments may further comprise material selected for its resistance to degradation due to weather or UV exposure. The brace 120 may be coupled to a surface of downspout material. The flexible material or flexing means may connect a sandwich mechanism 122 to a non-sandwich mechanism end. Alternatively the flexing means may connect a sandwich mechanism 122 to another sandwich mechanism 122.

Alternative exemplary embodiments comprise a sandwich mechanism extending from the brace end. In such embodiments the sandwich mechanism comprises a forked section forming a pocket between the legs of the fork. The legs of the fork are disposed adjacent the other and configured to receive material such as sheet metal. The sandwich mechanism is further configured to be secured or fastened to the material wherein the securing device is a screw and the screw is inserted through a first leg of the sandwich mechanism, then through the inserted material and then through the second let of the sandwich mechanism. The sandwich mechanism may be secured to the inserted material using other means and methods.

The ends of the brace are terminal sections of the brace's primary member. A primary member may comprise the structure that couples the ends of together. The primary member may comprise structure that is coplanar with the ends. Alternative exemplary embodiments further comprise primary member that is structure that is not coplanar with the ends. In hinge member 140 the primary member may comprise the side plates 144 coupled by the pivot member 135. The sandwich mechanism may extend beyond the end. Alternatively, a sandwich mechanism may be positioned co-terminal with the end. The end may comprise a sandwich mechanism 122 formed from a proximal portion of the front plate 146 and the distal portion of the front plate 152 forming fold 154 so the distal portion of the front plate 152 is disposed adjacent to the proximal portion of the front plate 152. Alternatively, the sandwich mechanism may comprise a U shaped structure secured to brace 120.

Alternatively an end may comprise a terminal portion comprising the structure of the non-end section of the brace. The length of the end section may be longer than the brace section, or alternatively, the end section may be shorter in length than the brace section. Alternatively, the brace 120 may comprise a sandwich mechanism on one end only.

The sandwich mechanism 122 may comprise plates of matching width. Alternatively one plate may have a wider width and the second plate may have a narrower width. Generally speaking, wider widths will be selected to improve surface contact between the sandwich mechanism 122 and any material which may be inserted between into pocket 156.

Alternatively, the sandwich mechanism may comprise one or more pilot hole(s) 40 to secure the sandwich mechanism to material inserted into the pocket.

The brace 120 may comprise structure falling primarily in a single plane, and the sandwich mechanism 122 occupying primarily coplanar the brace's plane. Alternatively, the brace may further comprise additional structure that occupies a plane that is substantially orthogonal the brace's plane. A brace comprising a surface orthogonal the primary brace's plane provides additional structural support to the brace and to the downspout structure to which the brace may be coupled. Additionally, the orthogonal surface may further comprise a pivot joint that allows brace to pivot through the arc formed between the ends of the primary brace.

The brace may further comprise a sandwich mechanism 122 comprising a proximal end 148 and a distal end 152 disposed adjacent each other. The ends may be folded or may be cast to dispose the ends adjacent the other.

The sandwich mechanisms 122 may be positioned on opposite sides of the brace, so that if one sandwich mechanism faces upward the other sandwich mechanism faces downwards. Such a configuration will create an offset differential between any material connected to the respective sandwich mechanisms.

Alternatively, the sandwich mechanism 122 may comprise a pivot member 135, also referred to herein as a pivot joint. The pivot joint 135 may be disposed between the sandwich mechanisms 122 along the primary member coplanar with the sandwich mechanism 122. Alternatively the pivot joint 135 may be disposed on a surface that is not coplanar with the sandwich mechanism 122, such as side member 144.

The hinge coupling strength, or the strength between the hinge and the downspout or downspout extension may be improved when the side plate 144 is used in connection with the front member 146 by creating two points of contact with the downspout, on both a vertical surface and a horizontal surface.

Figure 11C:
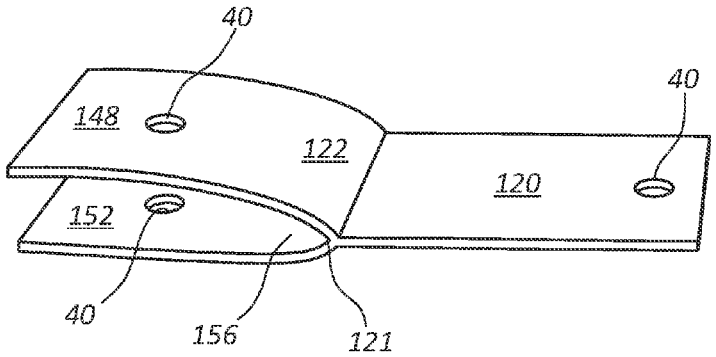
FIG. 11C illustrates a brace comprising a sandwich mechanism coupled to the end of the primary member.
Figure 11D:
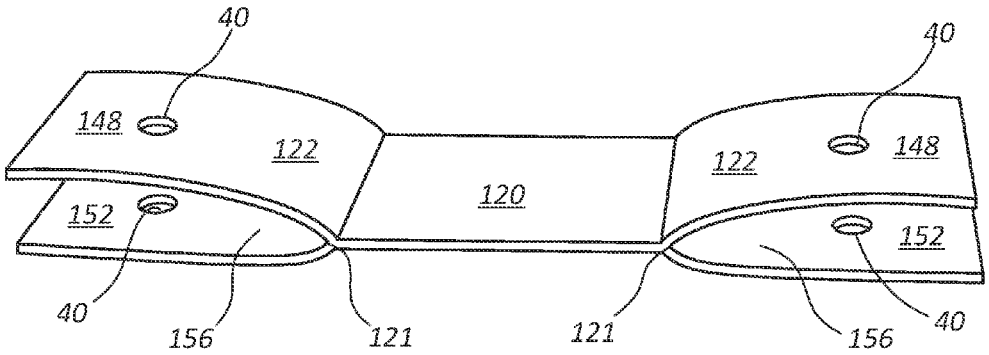
FIG. 11D illustrates a brace comprising a sandwich mechanism coupled to the ends of the brace's primary member.

Referring now to FIGS. 11C-11D, a brace comprising a sandwich mechanism coupled to the end 121 of the primary member. The sandwich mechanism 122 comprises a pocket 156 formed between a first front plate 148 and a second front plate 152. The pocket 156 receives material such as a downspout and the sandwich mechanism is secured to the material by a screw or other securing mechanism that passes through the first front plate, the material and the second front plate. An alternative exemplary embodiment comprises the sandwich mechanism being tightened to clamp the material in the pocket 156 of the sandwich mechanism. FIG. 11C shows the brace may comprise a sandwich mechanism 122 on one end of the brace. FIG. 11D illustrates the brace may comprise a sandwich mechanism of different configurations on opposite ends of the brace. Alternative embodiments may further comprise any sandwich mechanism disclosed herein being used in conjunction with any other sandwich mechanism. Indeed, alternative exemplary embodiments may further comprise the brace of FIG. 11C being hingedly connected to a hinged member of FIG. 11. The brace may be manufactured using roll form techniques, casting techniques, or injection techniques.

Figure 12A:
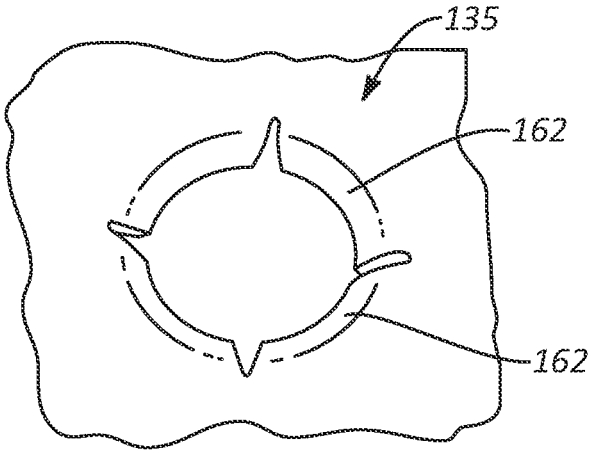
FIG. 12A illustrates an outside side view of a pivoting member, according to some embodiments.
Figure 12B:
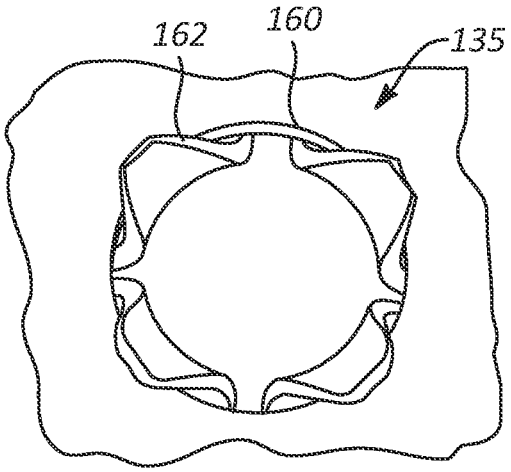
FIG. 12B illustrates an inside side view of the pivoting member of FIG. 12A.

FIGS. 12A and 12B illustrate close-up inside and outside views, respectively, of the pivot member 135 of FIG. 11. As shown, the pivot member 135 can provide relatively smooth operation of the hinge 124 without allowing for undesirable movement or play which could lead to failure of the hinge 124 over time. The pivot member 135 can include a aperture or hole 160 formed in one of the first or second side members 144 and leaves 162 formed in the other of the first or second side member 144. The leaves 162 are formed by a pierce in side member 144 which separates the leaves 162 and permits the leaves 162 to be manipulated independent of other leaves. As further shown, the leaves 162 can be folded in through the hole 160 and back on themselves to secure the leaves 162 within the hole 160. In some configurations, a lack of play and smoothness can be achieved in the pivot member 135 by creating a tight fitting between the leaves 162 and the hole 160. Furthermore, the tension of the pivot member 135 can be quickly and simply adjusted by crimping or loosening the leaves 162. Crimping the leaves 162 can adjust the holding power of the hinge when the downspout extension 22 is in the vertical position, even in instances in which the downspout extension has a length between about 1 foot to about 10 feet or increments therebetween.

The pivot member 135 may comprise a hinge pin; however, the pivot member 135 may also comprise the leaves of a first second side member 144 and the aperture or hole 160 of a second side member, the first and second side members 144 being coupled by passing the leaves 162 through the aperture or hole 160 and then the leaves receiving the inside surface of the hole 160 by the leaves being extended to wrap around the edge of the aperture.

In some embodiments, a brace 120 comprising a plurality of ends may couple two pieces of downspout, two pieces of downspout extension or a downspout to a downspout extension. The brace 120 may comprise a rigid section between two ends. Alternatively, a brace 120 may comprise a pivot joint to allow the ends to rotate around a central axis, as shown in FIGS. 11A-11B. Brace 120 comprises a first member comprising a sandwich mechanism. Alternative exemplary embodiments further comprise a brace comprising a first member comprising a sandwich mechanism and a second member comprising a sandwich mechanism. Alternative exemplary embodiments may further comprise a pivot joint or hinge.

Figure 13A:
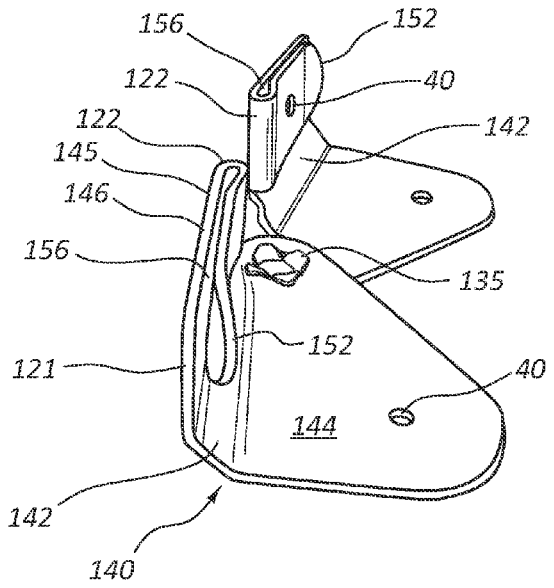
FIG. 13A illustrates an alternative perspective view of a hinge member.

FIGS. 13A-13D illustrate different perspective views of the brace 120 wherein the brace comprises a hinged member 140. In certain alternative exemplary embodiments the hinged member 140 is the brace 120 further comprising the pivot joint 135. Alternative exemplary embodiments of the hinge member further comprise a second plate 140. The term brace encompasses brace 120 and hinged member 140 and sandwich hinge 24. The hinged member 140 is a brace 120 with FIG. 13A shows the profile view of the hinge member 140 with the front member 146 comprising plate 148 which is the proximal plate, and a second plate 152 which is a distal plate. In certain exemplary embodiments, the sandwich mechanism 122 comprises the portion where the distal portion of the plate is adjacent the proximal portion of the plate.

Figure 13B:
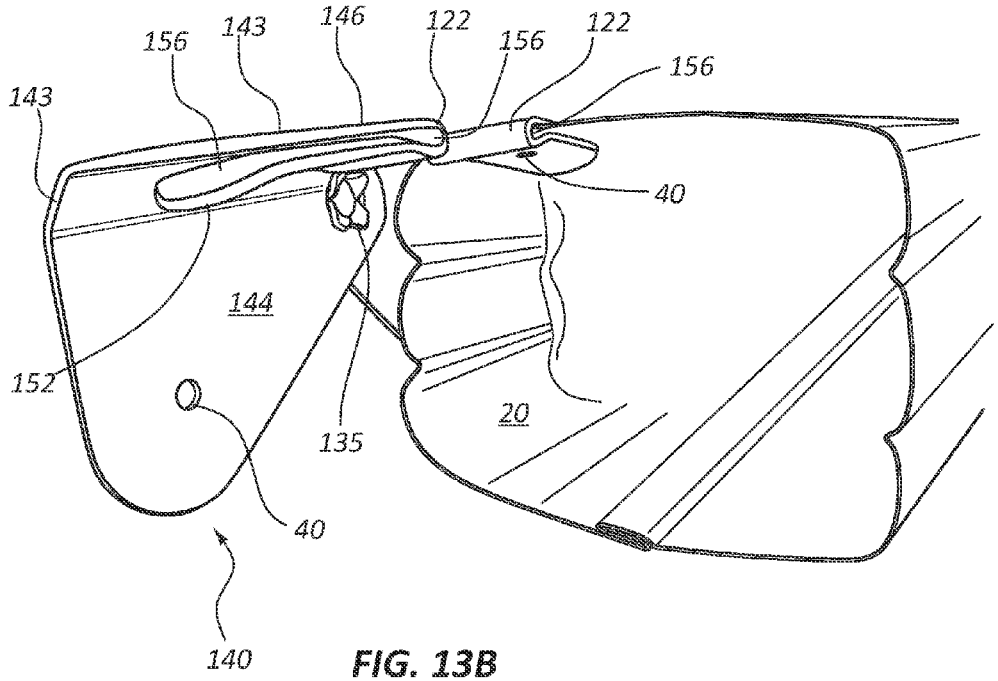
FIG. 13B illustrates an alternative perspective view of the hinge member further comprising downspout material inserted into the sandwich mechanism.

FIG. 13B illustrates a portion of material 20 placed in the pocket 156 of the sandwich mechanism 122. The material may be gutter material, downspout material or downspout extension material.

Figure 13C:
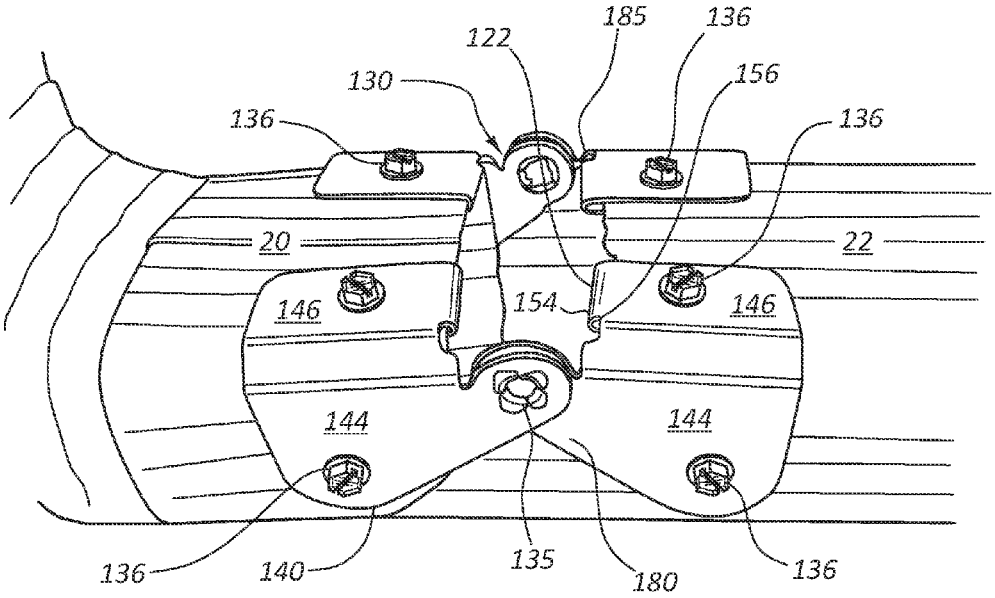
FIG. 13C illustrates an alternative perspective view of the hinge member coupling a downspout with a downspout extension.
Figure 13D:
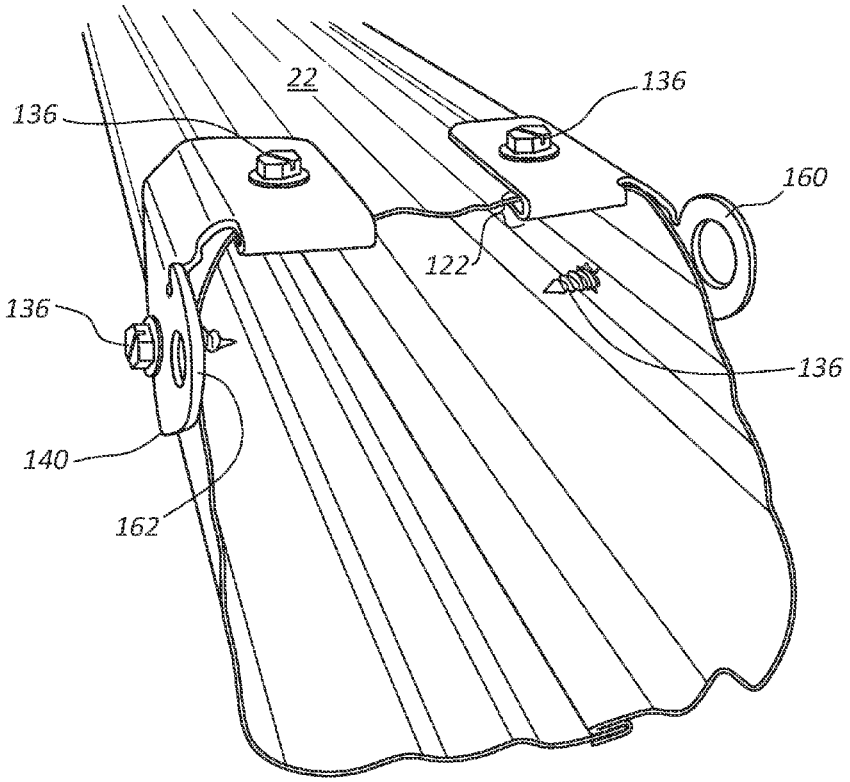
FIG. 13D illustrates an alternative view of a half of the hinge member comprising an aperture coupled to a portion of a downspout.
Figure 14:
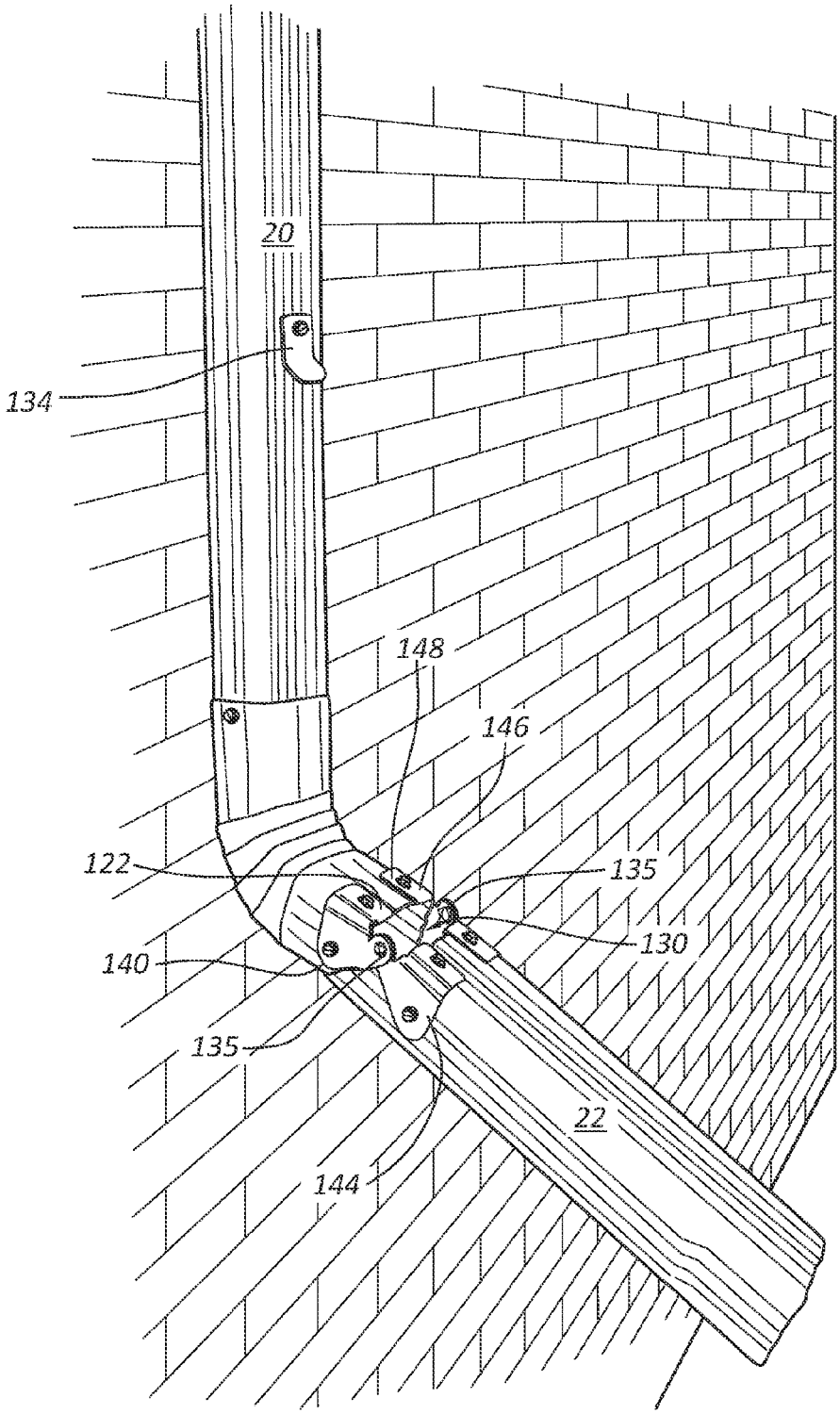
FIG. 14 illustrates an alternative view of a brace system coupling a downspout and a downspout extension.

FIG. 13C illustrates a system of downspout hinges coupling a downspout 22 to a downspout extension 20. The downspout hinge system comprises a first downspout hinge 180 coupled to two adjacent surfaces of the downspout and a second downspout hinge 185 coupled to an opposing adjacent surfaces of the downspout. The opposing surfaces are the anterior and lateral surfaces. An alternative exemplary embodiment may further comprise a hinge system 180 and 185 wherein the hinge is a brace 120 coupled to opposing sides of the same horizontal surface. Alternative exemplary embodiments may comprise the brace coupled to opposing vertical surfaces.

Aluminum downspouts are manufactured in a variety of sizes. Using a system of downspout hinges to couple a downspout to another downspout or downspout extension allows an installer to reduce the number of different-sized hinges in inventory or taken to job sites. The one size hinge will fit nearly sizes of aluminum downspouts.

The downspout hinge system of claim 1, wherein the at least one of the first and second downspout hinges comprises a first coupling surface and a second coupling surface about orthogonal the first coupling surface, the hinge comprising a support brace for the end of a downspout hinge. Alternative exemplary embodiments may further comprise the downspout hinge wherein the first and second downspout hinges are coupled to a horizontal surface of the downspout and the orthogonal surface is coupled to the lateral surface of the downspout. Alternative exemplary embodiments may further comprise the downspout hinge wherein a least one downspout hinge further comprises sandwich mechanism. Alternative exemplary embodiments may further comprise the downspout hinge wherein at least one downspout hinge further comprises downspout material inserted between a sandwich mechanism. Alternative exemplary embodiments may further comprise the downspout hinge, wherein a securing device secures the downspout hinge to downspout material.

The gap 130 is illustrated. The plurality of hinge members comprises a hinge system.

In certain exemplary embodiments the system may comprise the brace of FIG. 11A wherein the front member comprises a flexible material that allows the downspout extension to be displaced or repositioned. An alternative exemplary embodiment comprises the sandwich mechanism of hinge 24 in FIG. 3.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed:

1. A downspout hinge system comprising:

a downspout comprising a first side and a second side wherein the first side is positioned opposite the second side;

a downspout extension comprising a first side and a second side wherein the first side is positioned opposite the second side;

a first downspout hinge coupled to the first side of the downspout and the first side of the downspout extension; and a second downspout hinge coupled to the second side of the downspout and the second side of the downspout extension, the first and second downspout hinges coupled to the downspout and downspout extension comprising a downspout hinge system wherein the first downspout hinge further comprises a first, substantially planar surface, the first planar surface further comprising a flange positioned orthogonal the first planar surface the flange further comprising a sandwich mechanism: and wherein the second downspout hinge further comprises a second substantially planar surface coupled adjacent to the first planar surface by a pivot joint, the second planar surface further comprising a flange positioned orthogonal the second planar surface, the flange of the second downspout hinge further comprising a sandwich mechanism.

2. The downspout hinge system of claim 1 wherein the sandwich mechanism of each flange further comprises a pocket formed by bending the flange back on itself.

3. The downspout hinge system of claim 1, wherein the first planar surface and the second planar surface are triangular in shape.

4. The downspout hinge system of claim 1, wherein a least one of the downspout hinges further comprises sandwich mechanism further comprising a pocket formed by folding a portion of the downspout hinge back onto itself.

5. The downspout hinge system of claim 4, wherein at least one of the downspout hinges further comprises one of the downspout sides inserted into the pocket of the sandwich mechanism.

6. The downspout hinge system of claim 5, wherein one of the downspout sides is selectively secured to said one downspout hinge.

7. The downspout hinge system of claim 1 wherein the first and second downspout hinges comprise a pivot joint between the downspout and the downspout extension.

8. The downspout hinge system of claim 1 wherein the first or second hinge comprises a means for flexing to permit the distal ends of the downspout hinge to be repositioned relative to each other.

9. The downspout hinge system of claim 1 further comprising:

the first downspout hinge comprising a first distal end and a second distal end, the hinge further comprising means for rotating or flexing so as to allow the position of the first distal end to change in relation to the position of the second distal end; and the second downspout hinge comprising a first distal end and a second distal end, the hinge further comprising means for rotating or flexing so as to allow the position of first end to change in relation to the position of the second end, wherein the first distal end of the first hinge and the first distal end of the second hinge are selectively coupled to the downspout and wherein the second distal end of the first hinge and the second distal end of the second hinge are selectively coupled to the downspout extension.

10. A downspout hinge system comprising:

a downspout;

a downspout extension;

a downspout hinge comprising a first triangular, substantially planar surface;

the first planar surface further comprising an annular hole positioned in one corner of the triangular shape;

the first planar surface further comprising a flange positioned orthogonal the first planar surface further comprising a sandwich mechanism configured to receive a downspout or a downspout extension;

a second substantially planar surface coupled to the first planar surface wherein the first surface is coupled to the second surface by a pivot joint, wherein the pivot joint comprises a plurality of leaves formed from piercing the second substantially planar surface which leaves are passed through the annular hole in the first planar surface, wherein the leaves are bent around the annular lip formed at the edge of the hole in the first surface so as to permit the second planar surface to slide past and pivot relative to the first planar surface;

the second planar surface further comprising a flange positioned orthogonal the second surface, the flange further comprising a sandwich mechanism, the sandwich mechanism of the second planar surface comprising a pocket formed between the flange being bent back on itself, the sandwich mechanism of the second planar surface configured to receive a downspout or a downspout extension; and the downspout, downspout hinge and downspout extension comprising a downspout assembly.

* * * * *